US005524592A

United States Patent [19]

Woody et al.

[11] Patent Number: 5,524,592

[45] Date of Patent: Jun. 11, 1996

[54] ANTI-SIPHON AND ANTI-LEANOUT FUEL VALVE

[75] Inventors: John C. Woody; Kenneth J. Cotton, both of Caro, Mich.

[73] Assignee: Walbro Corporation, Cass City, Mich.

[21] Appl. No.: 465,558

[22] Filed: Jun. 5, 1995

[51] Int. Cl.[6] ..... F02M 37/04

[52] U.S. Cl. ..... 123/510; 123/198 DB; 137/907; 137/462

[58] Field of Search ..... 123/510, 198 D, 123/198 DB, 497, 509; 137/907 X, 458, 462 X, 624.27; 251/79, 81

[56] References Cited

U.S. PATENT DOCUMENTS

| | | | |
|---|---|---|---|
| 3,800,736 | 4/1974 | Krohn | 137/624.27 |
| 4,252,094 | 2/1981 | Praxler | 123/198 DB |
| 4,730,591 | 3/1988 | Gohara | 123/510 |
| 4,853,160 | 8/1989 | Wood | 251/81 |
| 4,880,403 | 11/1989 | Friedle | 123/198 DB |
| 4,957,084 | 9/1990 | Kramer | 123/198 DB |
| 5,148,992 | 9/1992 | Tuckey | 123/514 |
| 5,297,578 | 3/1994 | Scott | 137/907 |
| 5,329,899 | 7/1994 | Sawert | 123/198 DB |
| 5,361,742 | 11/1994 | Briggs | 123/514 |

FOREIGN PATENT DOCUMENTS

| | | | |
|---|---|---|---|
| 1184720 | 3/1920 | United Kingdom | 137/462 |

*Primary Examiner*- Carl S. Miller
*Attorney, Agent, or Firm*- Barnes, Kisselle, Raisch, Choate, Whittemore & Hulbert

[57] ABSTRACT

A flow control valve for an internal combustion engine fuel delivery system that includes a valve body having a fuel inlet for connection to a fuel supply and a fuel outlet for connection to the fuel pump, so that the pump can draw fuel under vacuum from the supply through the valve and deliver fuel to an engine. A valve element is disposed within the valve body between the inlet and the outlet, and springs urge the valve element to a closed position within the valve body. A diaphragm is also disposed within the valve body between the valve element and the fuel outlet, and is coupled to the valve element such that suction vacuum applied by a fuel pump to the valve body outlet operates the diaphragm to open the valve element against forces applied by the valve springs to permit flow of fuel from the supply through the valve to the pump. The diaphragm is coupled to the valve element by a resilient detent mechanism responsive to vacuum at the valve outlet above a preselected level for releasing the coupling engagement between the diaphragm and the valve element, such that the valve is closed by the springs to terminate flow of fuel to the valve outlet.

10 Claims, 1 Drawing Sheet

ANTI-SIPHON AND ANTI-LEANOUT FUEL VALVE

The present invention is directed to fuel delivery systems for internal combustion engines, and more particularly to a fuel flow control valve for disposition between a fuel pump and a fuel supply.

BACKGROUND AND SUMMARY OF THE INVENTION

In some conventional internal combustion engine fuel delivery systems, a fuel pump disposed on or adjacent to the engine draws fuel under vacuum from a remote tank or other fuel supply. Fuel delivery systems of this character are particularly prevalent in marine applications, and can also be employed in automotive and other like applications. The fuel line between the supply tank and the engine can be punctured or severed, whereupon the fuel may be siphoned from the tank. The fuel filter, normally disposed within the tank or in-line and upstream of the fuel pump, can become clogged, starving the fuel pump and engine for fuel, leaning out the air/fuel mixture at the engine, and potentially causing serious damage such as cease-up at the engine.

It is therefore a general object of the present invention to provide a fuel flow control valve for disposition between the fuel supply and the fuel pump that will prevent fuel from siphoning out of the fuel supply if the fuel line to the pump becomes punctured or severed. Another object of the present invention is to provide a fuel flow control valve that will prevent lean-out of fuel at the engine in the event of plugging at the fuel filter or other obstruction in the fuel line. A further object of the present invention is to provide an anti-leanout fuel flow control valve that automatically resets when the engine turns off, so that the engine can be restarted and operated in a "limp home" mode.

A flow control valve for an internal combustion engine fuel delivery system in accordance with the present invention includes a valve body having a fuel inlet for connection to a fuel supply and a fuel outlet for connection to the pump, so that the pump can draw fuel under vacuum from the supply through the valve and deliver fuel to an engine. A valve element is disposed within the valve body between the inlet and the outlet, and springs urge the valve element to a closed position within the valve body. A diaphragm is also disposed within the valve body between the valve element and the fuel outlet, and is coupled to the valve element such that suction vacuum applied by a fuel pump to the valve body outlet operates the diaphragm to open the valve element against forces applied by the valve springs to permit flow of fuel from the supply through the valve to the pump. The diaphragm is coupled to the valve element by a resilient detent mechanism responsive to vacuum at the valve outlet above a preselected level for releasing the coupling engagement between the diaphragm and the valve element, such that the valve is closed by the springs to terminate flow of fuel to the valve outlet.

In the preferred embodiment of the invention, a valve stem extends from the valve element, and link arms extend from the diaphragm for external engagement with the valve stem. A split spring ring surrounds the link arms and urges the link arms into a recess on the valve stem for directly coupling the diaphragm to the valve element. A first spring is disposed between the valve body and the valve element for directly urging the valve element toward a closed position, and a second spring is disposed between the valve body and the diaphragm for urging the valve element toward a closed position through the diaphragm/element coupling. When suction vacuum at the valve outlet exceeds the capacity of the split ring, the ring expands and the link arms move out of the recess on the valve stem, so that the valve element is closed by the first spring independent of the diaphragm to terminate flow of fuel to the engine. When the engine and pump have stopped, release of suction vacuum at the valve outlet allows the second spring to urge the diaphragm away from the valve element. A conical camming surface on the valve stem expands the split ring sufficiently that the split ring and link arms re-engage the recess in the valve stem. Thus, when the engine is restarted, suction vacuum at the valve outlet reopens the valve through the diaphragm, and the engine may be operated in a low-power "limp home" mode, in which engine demand and suction at the valve outlet do not release the spring detent and reclose the valve.

BRIEF DESCRIPTION OF THE DRAWING

The invention, together with additional objects, features and advantages thereof, will be best understood from the following description, the appended claims and the accompanying drawing in which:

DETAILED DESCRIPTION OF PREFERRED EMBODIMENT

Figure 1:
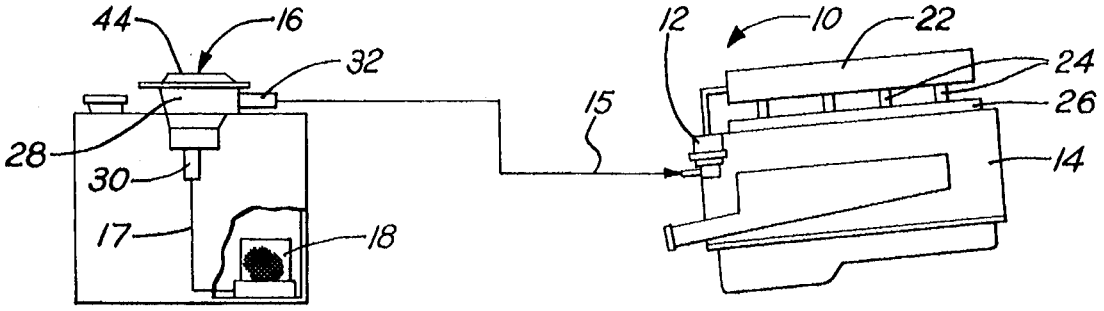
FIG. 1 is a schematic diagram of an internal combustion engine fuel delivery system in accordance with a presently preferred implementation of the invention.

FIG. 1 illustrates an internal combustion engine fuel delivery system 10 that includes a fuel pump 12 mounted on an engine 14. Fuel pump 12 has an inlet connected by a line 15 to a flow control valve 16 mounted on a fuel supply tank 20, and thence by a line 17 to a fuel filter 18 both disposed within tank 20. The outlet of pump 12 is connected to deliver fuel under pressure to a fuel rail 22 mounted on engine 14. A plurality of fuel injectors 24 extend between fuel rail 22 and the engine air intake manifold 26 for delivering fuel to the cylinders of engine 14. Fuel pump 12 thus draws fuel under suction or vacuum from supply tank 20 through filter 18 and valve 16, and delivers fuel under pressure to fuel rail 22.

Figure 2:
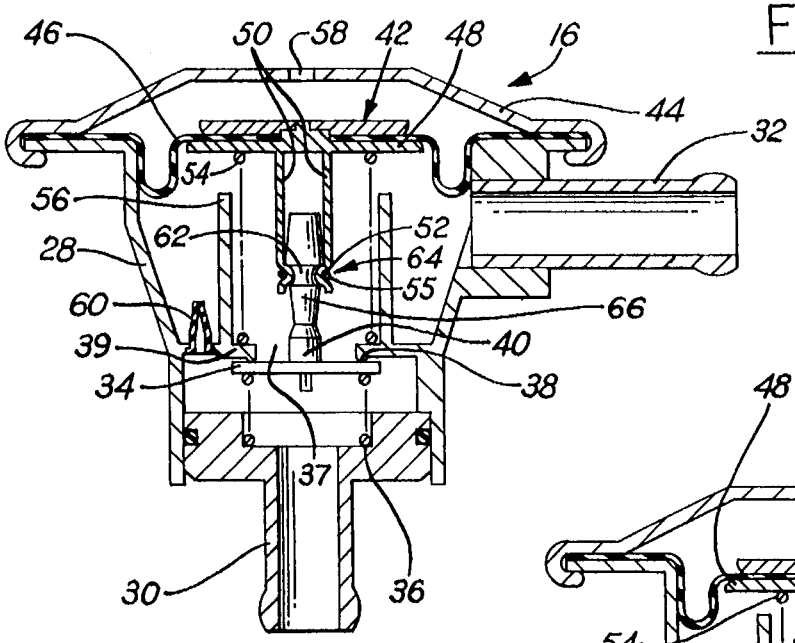
FIG. 2 is a sectional view diametrically bisecting a fuel flow control valve in accordance with a presently preferred embodiment of the invention.

Fuel flow control valve 16 is illustrated in greater detail in FIG. 2 as comprising a valve body 28 having an inlet fitting 30 for connection to fuel supply 20 and an outlet fitting 32 for connection to pump 12. A valve element 34 is centrally disposed within housing 28 in alignment with inlet fitting 32. A coil spring 36 urges valve element 34 against a seat 38 that surrounds an opening 37 in a transverse wall 39 within housing 28. A valve stem 40 is monolithically integral with or fastened to valve element 34, coaxially projecting upwardly therefrom (in the orientation of FIG. 2) through opening 37 toward outlet fitting 32.

Figure 5:
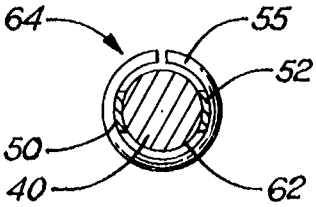
FIG. 5 is a sectional view taken substantially along the line 5–5 in FIG. 4.

A diaphragm assembly 42 is mounted to valve body 28 by a valve cover 44. Diaphragm assembly 42 includes a resilient diaphragm 46 of elastomeric construction having a plate element 48 centrally mounted thereto. Two or more link arms 50 project downwardly from plate 48 for external engagement with valve stem 40 on diametrically opposed sides thereof. Link arms 50 have diametrically opposed inward bends 52 that are embraced by a split spring ring 55 (FIGS. 2 and 5). A coil spring 54 is captured in compression between transverse wall 39 in valve body 28 and plate 48 on diaphragm assembly 42 coaxially surrounding valve seat 38 and valve element 34. A cylindrical or partitioned wall 56 extends from transverse wall 39 concentrically with opening 37 and valve stem 40. Wall 56 functions both to maintain position of spring 54 and as a stop against movement of diaphragm assembly 42, as will be described. Diaphragm assembly 42 thus divides valve assembly 16 into a lower chamber surrounded by valve body 28 through which fuel flows, and an upper chamber that is referenced to atmosphere through an opening 58 in cover 44. A check valve 60 is carried by transverse wall 39 between inlet fitting 30 and outlet fitting 32 for relieving vacuum within valve body 28, as will be described. Thus, if fuel line 15 between pump 12 and valve 16 becomes severed or punctured, fuel cannot be siphoned out of supply tank 20.

Figure 3:
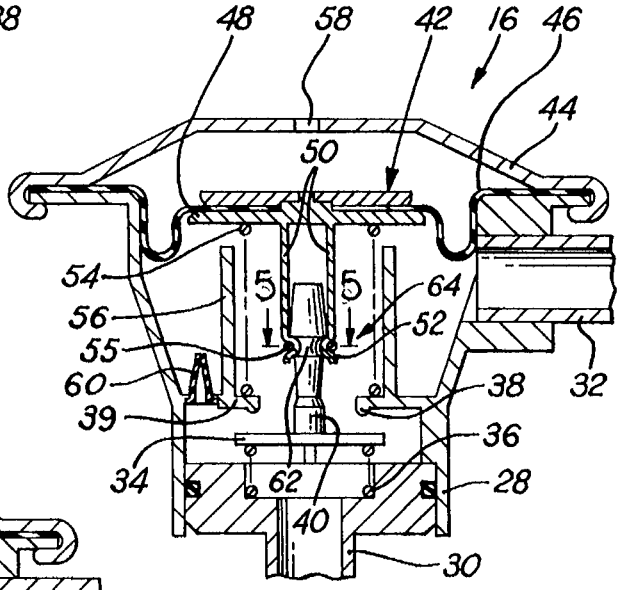
FIGS. 3 and 4 are fragmentary sectional views similar to that of FIG. 2 showing the valve in differing modes of operation.

In operation with engine 14 and pump 12 turned off, flow control valve 16 assumes the configuration illustrated in FIG. 2. Split spring ring 55 urges bends 52 of link arms 50 into a recess 62 on valve stem 40, thus forming a spring detent that couples diaphragm assembly 42 to valve element 34. Valve element 34 is urged to the normally closed position illustrated in FIG. 2 by coil spring 36 that acts directly on valve element 34, and coil spring 54 that acts on valve 34 through link arms 50 and valve stem 40. When engine 14 and pump 12 are started, the suction vacuum applied by pump 12, normally between about one and five inches of mercury, pulls diaphragm assembly downwardly against the forces applied by springs 36,54, thus operating through spring detent 64 to urge valve 34 downwardly and open flow from inlet fitting 30 to outlet fitting 32 as illustrated in FIG. 3. Fuel thus flows freely through valve assembly 16 under normal operating and load conditions as long as the suction vacuum remains between one and five inches of mercury.

Figure 4:
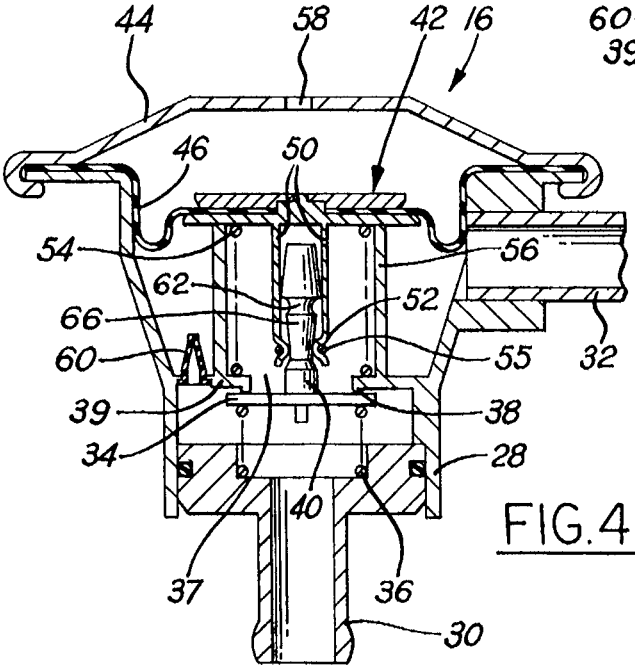

In the event that fuel filter 18 becomes clogged or fuel line 17 is otherwise obstructed, increased fuel pump suction vacuum applies additional force pulling diaphragm assembly 42 downwardly in the orientation of the drawings. When this force exceeds the capacity of split ring 55 in spring detent 64, the camming action of recess 62 expands split spring ring 55 diametrically outwardly, so that bends 52 and link arms 50 are released from detent 64 and move downwardly along the external surface of valve stem 40, as shown in FIG. 4. Since diaphragm assembly 42 is no longer directly coupled to valve element 34. Valve element 34 is urged by spring 36 against seat 38, thereby closing valve assembly 16 and terminating flow of fuel through the valve to fuel pump 12 (except for small amount through valve 60, which is too small to run the engine). Downward motion of diaphragm assembly 42 is stopped by the upper edge of wall 56 so that suction on the diaphragm assembly does not push the valve open. Rather than running in an excessively lean condition that might damage the engine, the fuel pump and engine are starved for fuel and the engine ceases operation.

Thus, when the vacuum applied by the fuel pump exceeds the preselected level associated with resiliency of split ring 55, such as a level of five inches of mercury, valve assembly 16 is closed and engine operation ceases. When this occurs, pump 12 no longer applies vacuum to the valve outlet, and coil spring 54 urges diaphragm assembly 42 and link arms 50 upwardly. As this occurs, link arms 50 and split ring 55 are diametrically expanded by motion along the conical camming surface 66 of valve stem 40 until bends 52 of link arms 50 again engage notch 62 on valve stem 40. Thus, spring detent 64 is automatically reset and re-engaged when engine and fuel pump operation terminates. Check valve 60, which is normally closed with a pressure drop of less than one inch of mercury, releaves vacuum down to one inch of mercury within chamber 37 of valve assembly 16. With valve assembly 16 again in the configuration of FIG. 2, the engine and fuel pump may be restarted. Of course, with the clogged fuel filter or other obstruction remaining in the fuel line, the engine cannot be operated under high load or flow control valve 16 will again assume the configuration of FIG. 4 and terminate engine operation. However, the engine can be operated under low load so that the boat or other vehicle can "limp home."

A cut in line 15 and resultant fuel siphon effect would not cause a vacuum at 32 greater than one inch of mercury. This would therefore be insufficient to cause diaphragm 42 to move against the preload on spring 54 or cause flow through valve 60. There would be no fuel leakage through the cut in line 15.

We claim:

1. A flow control valve for an internal combustion engine fuel delivery system having a fuel pump for drawing fuel under vacuum from a supply and delivering fuel to an engine, said valve being for disposition between the fuel supply and the pump and comprising:

a valve body having a fuel inlet for connection to the fuel supply and a fuel outlet for connection to the pump, valve means disposed within said valve body between said inlet and said outlet, including spring means for urging said valve means to a closed position within said valve body, a diaphragm disposed within said valve body between said valve means and said outlet, and means coupling said diaphragm to said valve means such that suction vacuum applied by said fuel pump to said valve body outlet operates on said diaphragm to open said valve means against said spring means and permit flow of fuel from the supply through said valve to the pump, said coupling means including resilient detent means responsive to vacuum at said outlet above a preselected level for releasing said coupling means such that said valve means is closed by said spring means effectively to terminate flow of fuel to said outlet.

2. The valve set forth in claim 1 wherein said coupling means comprises a valve stem on one of said valve means and said diaphragm, link means on the other of said valve means and said diaphragm, and a coupling spring resiliently urging said link means into engagement with said valve stem, said detent means comprising means on said valve stem and link means for overcoming force of said coupling spring and disengaging said valve stem from said link means.

3. The valve set forth in claim 2 wherein said link means externally engages said valve stem, and wherein said coupling spring externally surrounds said link means, said valve stem including a recess into which said coupling spring urges said link means.

4. The valve set forth in claim 3 wherein said spring means comprises a first spring disposed between said valve body and said valve means and a second spring disposed between said valve body and said diaphragm.

5. The valve set forth in claim 4 further comprising cam means on said valve stem for opening said coupling spring as said second spring urges said diaphragm away from said valve means upon removal of vacuum suction from said outlet so as to reset said resilient detent means.

6. The valve set forth in claim 5 further comprising a check valve disposed in parallel with said valve means to release vacuum in said valve body.

7. The valve set forth in claim 1 wherein said spring means comprises a first spring disposed between said valve body and said valve means and a second spring disposed between said valve body and said diaphragm.

8. The valve set forth in claim 7 wherein said coupling means further includes cam means for resetting said detent means as said second spring urges said diaphragm away from said valve means upon release of suction vacuum at said outlet while said first spring holds said valve means closed.

9. The valve set forth in claim 8 wherein said coupling means comprises a valve stem extending from said valve means, link means extending from said diaphragm externally of said valve stem and spring means surrounding said link means and urging said link means into external engagement with said valve stem, said detent means comprising a recess in said valve means and said cam means comprising a conical surface on said valve stem for expanding said spring means to a diameter for engagement with said recess.

10. The valve set forth in claim 9 further comprising a check valve disposed in parallel with said valve means to release vacuum in said valve body.

* * * * *